US006323472B1

(12) United States Patent
Coleman

(10) Patent No.: US 6,323,472 B1
(45) Date of Patent: Nov. 27, 2001

(54) RADIANT ELECTRIC HEATER FOR A MICROWAVE OVEN

(75) Inventor: Gavin John Coleman, Bromsgrove (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 09/652,079

(22) Filed: Aug. 31, 2000

(30) Foreign Application Priority Data

Sep. 10, 1999 (GB) ..... 9921297

(51) Int. Cl.[7] ..... H05B 6/80; H05B 6/78

(52) U.S. Cl. ..... 219/685; 219/754; 219/395; 219/397; 219/478; 219/537

(58) Field of Search ..... 219/681, 685, 219/754, 753, 756, 395, 396, 397, 398, 476, 477, 478, 479, 537

(56) References Cited

U.S. PATENT DOCUMENTS

| | | | | |
|---|---|---|---|---|
| 2,035,767 | * | 3/1936 | Schulze | 219/398 |
| 4,020,323 | * | 4/1977 | Dills | 219/398 |
| 4,326,113 | * | 4/1982 | Toyoda et al. | 219/685 |
| 4,535,226 | * | 8/1985 | Logel et al. | 219/396 |
| 4,771,154 | | 9/1988 | Bell et al. | 219/685 |
| 5,504,310 | * | 4/1996 | Bae | 219/685 |
| 6,172,347 | * | 1/2001 | Lee | 219/685 |

FOREIGN PATENT DOCUMENTS

| | | | | |
|---|---|---|---|---|
| 4027777 | | 5/1992 | (DE) . | |
| 2 159 285 | * | 6/1973 | (DE) | 219/395 |
| 30 40 113 | * | 5/1982 | (DE) | 219/685 |
| 2 380 682 | * | 9/1978 | (FR) | 219/397 |

* cited by examiner

*Primary Examiner*—Philip H. Leung
(74) *Attorney, Agent, or Firm*—Ira S. Dorman

(57) ABSTRACT

A microwave oven (1) comprises an oven cavity (3) containing a rotatable turntable (4) for supporting one or more items to be heated. A radiant electric heater (5) is arranged for location above the turntable (4) and comprises at least one first heating element (6) and at least one second heating element (7). The at least one first heating element (6) overlies only a proportion of the total upper surface area of the turntable (4) such that, in operation, for each complete rotation of the turntable substantially all parts of the upper surface of the turntable are heated for substantially the same duration of time, the at least one first heating element (6) providing a first power density. The at least one second heating element (7), or a combination with the at least first heating element (6), overlies substantially the total upper surface area of the turntable (4), with the at least one second heating element operated alone, or an operating combination of the at least one second heating element (7) with the at least one first heating element (6), providing a second power density lower than the first power density.

14 Claims, 4 Drawing Sheets

RADIANT ELECTRIC HEATER FOR A MICROWAVE OVEN

BACKGROUND TO THE INVENTION

It is known to provide microwave ovens with heating devices additional to the microwave heating means. In particular, radiant electric heating devices are known to be located at the top of the oven cavity to provide high power density for grilling or browning food items or moderate power density for baking food items.

At present, products are available which can achieve either baking or browning cooking effects but cannot provide both from the same heater. Either the baking element would operate at too low a power density to grill or the grilling element would be too hot to bake without burning. A grilling heater cannot be arranged to cover the entire area of an underlying turntable in the oven as it would require far too high power and smaller grilling heaters can result in uneven heating of the underlying turntable.

It is also necessary to locate a heater used for high power grilling as far away from the oven door as possible, to prevent damage to the door and to reduce the temperature experienced by a user of the oven.

OBJECT OF THE INVENTION

It is an object of the present invention to overcome or minimise these problems.

SUMMARY OF THE INVENTION

According to the present invention there is provided a radiant electric heater for a microwave oven, the oven comprising an oven cavity having therein a rotatable turntable for supporting one or more items to be heated, the radiant electric heater being arranged for location above the turntable and comprising at least one first heating element and at least one second heating element, the at least one first heating element being adapted and arranged to overlie only a proportion of the total upper surface area of the turntable to the extent that in operation alone, for each complete rotation of the turntable substantially all parts of the upper surface of the turntable are heated for substantially the same duration of time, the at least one first heating element providing a first power density, and the at least one second heating element being adapted and arranged such that it, or a combination thereof with the at least first heating element, overlies substantially the total upper surface area of the turntable, and such that the at least one second heating element operated alone, or an operating combination of the at least one second heating element with the at least one first heating element, provides a second power density lower than the first power density.

The at least one first heating element may be located within the confines of the at least one second heating element.

The at least one first heating element may be provided to occupy a substantially rectangular, or part-annular, or arcuate, region of the heater. Such part-annular or arcuate region of the heater may subtend an angle of about 180 degrees.

A single first heating element and a single second heating element may be provided.

Alternatively a single first heating element and two further heating elements may be provided, one of the further heating elements being arranged substantially complementary to the first heating element, a plurality of second heating elements being provided in operation comprising the other of the further heating elements connected in series with a parallel combination of the first heating element and the one of the further heating elements.

As a further alternative, at least one first heating element and first and second further heating elements may be provided, a plurality of second heating elements being provided in operation comprising the first of the further heating elements connected in parallel with a series combination of the at least one first heating element and the second of the further heating elements.

The at least one first heating element may be located in the heater such as to be as remote as possible from a door of the microwave oven.

The first power density may be such as to provide grilling and/or browning of one or more food items located in the oven cavity.

The second power density may be such as to provide baking of one or more food items located in the oven cavity. The at least one first heating element and the at least one second heating element may comprise any of the well known forms such as coiled wire, metal ribbon, metal foil or lamp forms, or combinations thereof.

The at least one first heating element and the at least one second heating element may be supported relative to a base of thermal insulation material, such as microporous thermal insulation material.

A dish-like supporting means may be provided for the heater.

By means of the invention a single radiant heater is provided for installation in a microwave oven and which will achieve quick, efficient and even grilling and browning, when the oven turntable is used. The same heater provides a baking facility of lower power density and which provides an even baking effect over the entire oven cavity at a reasonable baking position. Advantages are low cost with high functionality and efficiency since the best cooking element for the purpose is always available.

For a better understanding of the present invention and to show more clearly how it may be carried into effect reference will now be made, by way of example, to the accompanying drawings in which:

DESCRIPTION OF PREFERRED EMBODIMENTS

Figure 1:
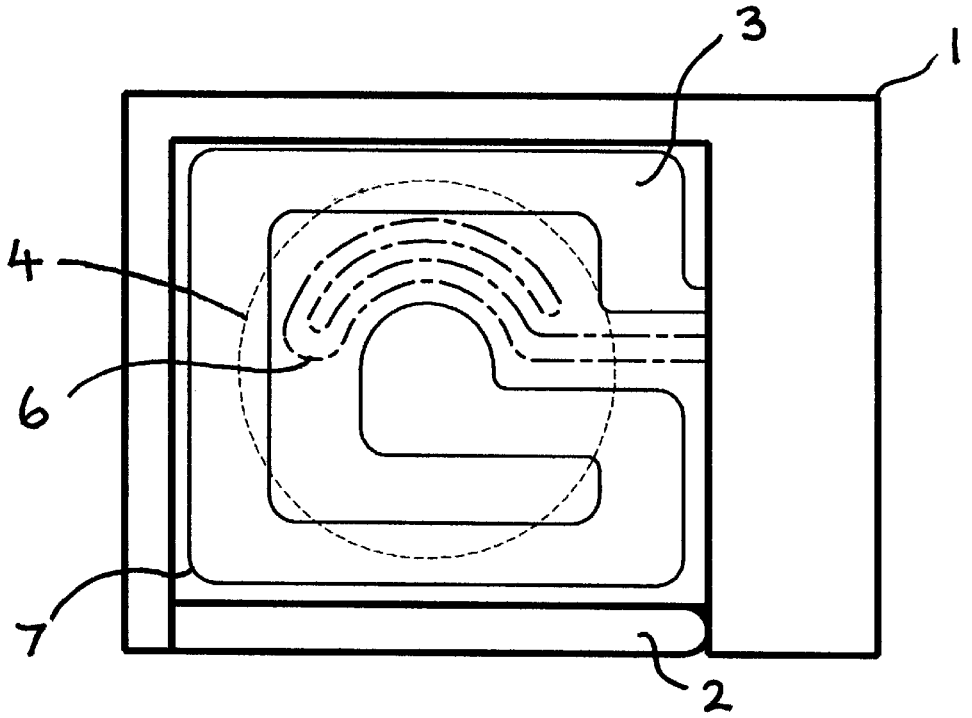
FIG. 1 is a schematic top plan view representation of a microwave oven incorporating a radiant electric heater according to the present invention.

Referring to FIG. 1, a microwave oven 1 has a door 2 and is provided with an oven cavity 3. The basic construction of the oven is of well known form and features such as a magnetron for the source of microwave radiation are not shown since they are not essential to an understanding of the invention.

A well-known form of turntable 4 is provided in the oven cavity and arranged for rotation by well known means (not shown). The turntable 4 is intended for supporting one or more food items, or containers thereof, to be heated.

Figure 3:
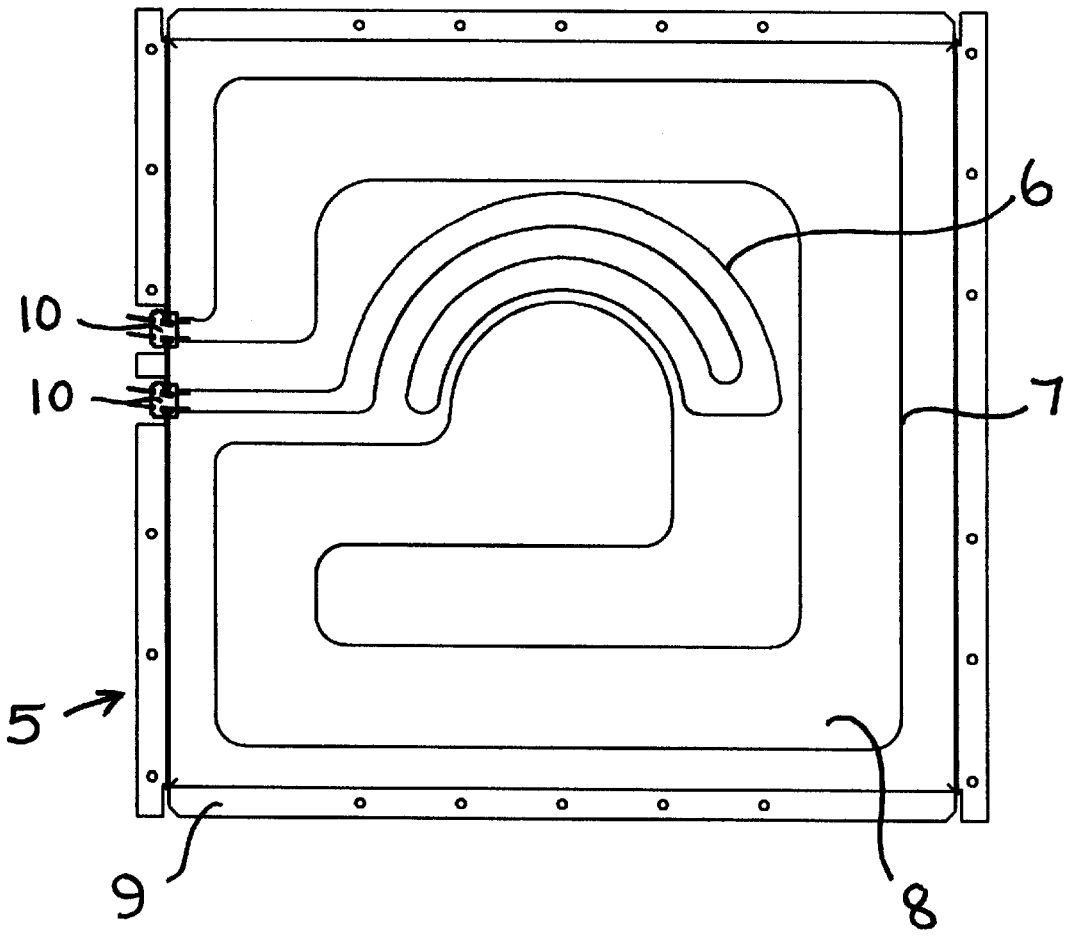
FIG. 3 is a plan view of the radiant electric heater of the invention as incorporated in the microwave oven of FIGS. 1 and 2.

A radiant electric heater 5, as shown in detail in FIG. 3, is located at the top of the oven cavity overlying the turntable 4. The heater 5 comprises a first radiant heating element 6 and a second radiant heating element 7 supported relative to a base 8 of microporous thermal insulation material in a dish-like supporting means 9. The heating elements are of well-known form, such as coiled wire, metal ribbon, metal foil, or lamp forms or combinations thereof.

A terminal block arrangement 10 at the edge of the heater provides for connection of the heating elements 6 and 7 to a power supply (not shown) for independent energisation thereof.

The first heating element 6 is arranged to occupy a substantially part-annular or arcuate region of the heater with such substantially part-annular or arcuate region suitably subtending an angle of about 180 degrees. The first heating element 6 is located within the confines of the second heating element 7, the second heating element 7 being relatively large with quite widely spaced element turns.

Alternatively, the first heating element 6 may be arranged to occupy a substantially rectangular region of the heater.

The first heating element 6 is arranged to provide a relatively high power density, for example about 5 watts per square centimetre, suitable for browning or grilling a food item on the underlying turntable 4. The first heating element 6 is arranged in the heater so as to be as remote as possible from the door 2 of the oven when the heater is installed in the oven.

Figure 2:
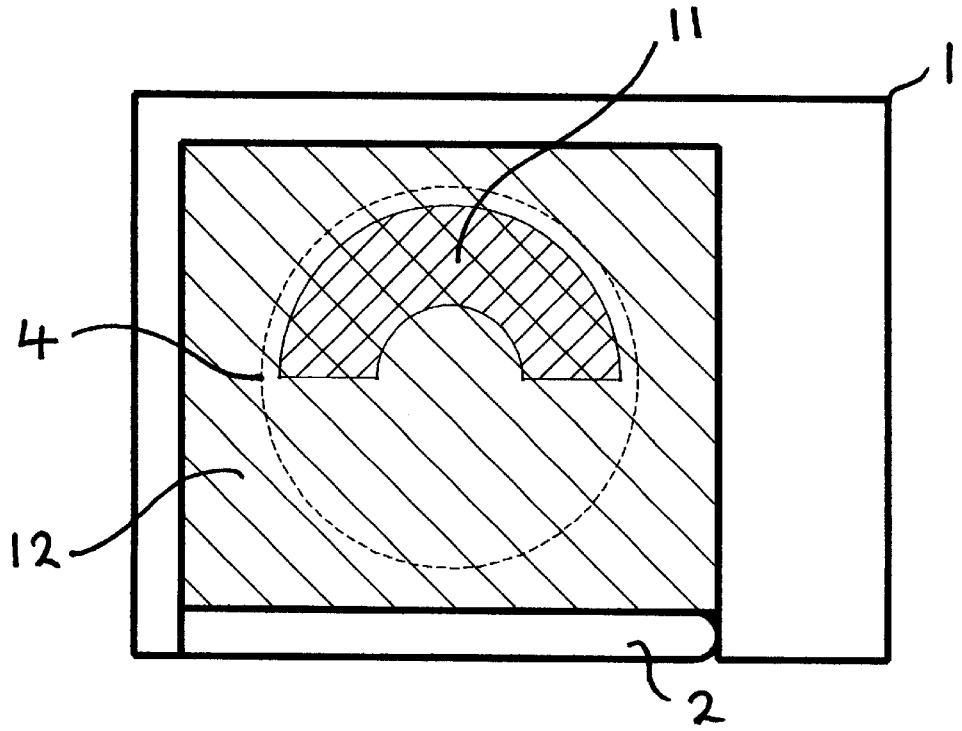
FIG. 2 is a schematic top plan view representation of the microwave oven of FIG. 1, illustrating the heating zones provided by a radiant electric heater according to the present invention.

The first heating element 6 overlies only a proportion of total upper surface area of the turntable so that it provides a heated zone as denoted by reference numeral 11 in FIG. 2. When the heating element 6 is in operation alone, it is arranged that for each complete rotation of the turntable 4 substantially all parts of the upper surface of the turntable are heated for substantially the same duration of time. Thus uniform grilling or browning of food items on the turntable is achieved.

The second heating element 7 is arranged to overlie at least substantially the total upper surface area of the turntable 4 and if required substantially the entire base of the oven cavity. It is arranged for operation alone (that is without operation of the first heating element 6) and provides a lower power density than the first heating element 6. Such lower power density may be of the order of 2 watts per square centimetre and provides an even baking effect for food items located on the turntable 4 or on a shelf inserted into the oven cavity. The heated zone resulting from the second heating element is typically as denoted by reference numeral 12 in FIG. 2.

Figure 4:
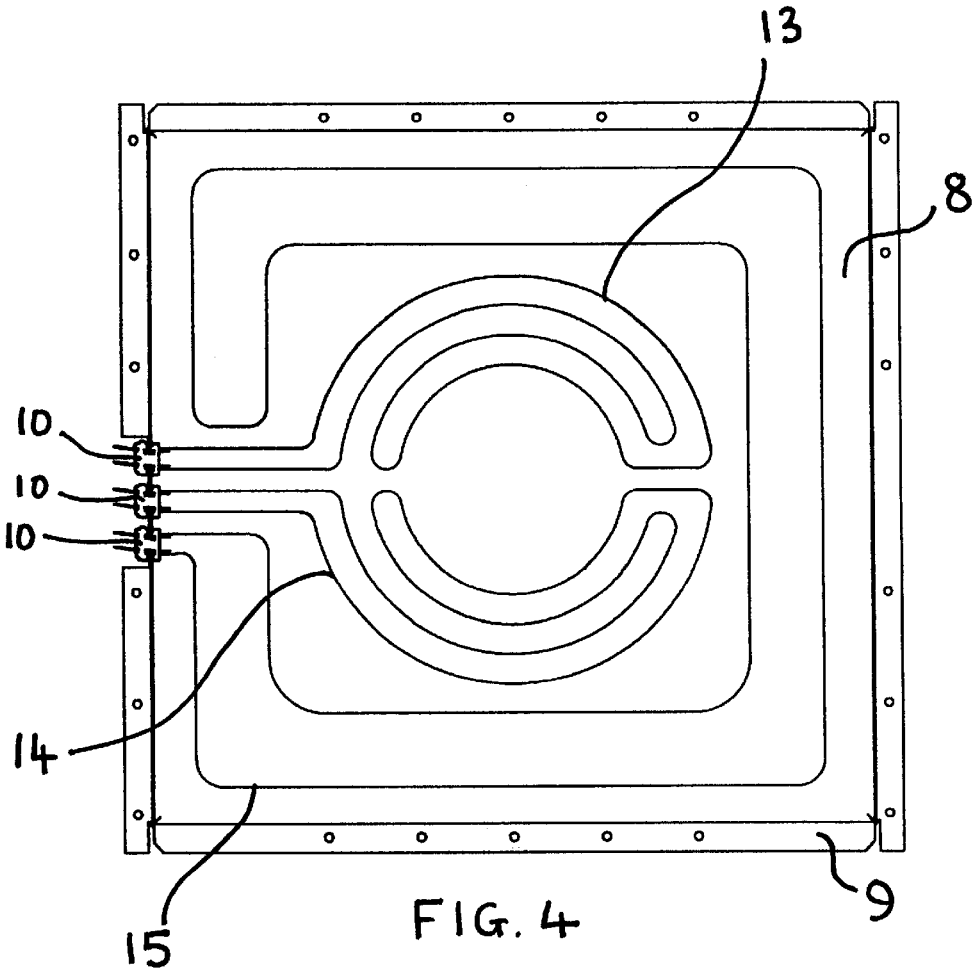
FIG. 4 is a plan view of an alternative arrangement of radiant electric heater according to the present invention.

Instead of a heater as shown in FIG. 3, an alternative form of heater as shown in FIG. 4 may be provided.

Figure 5A:
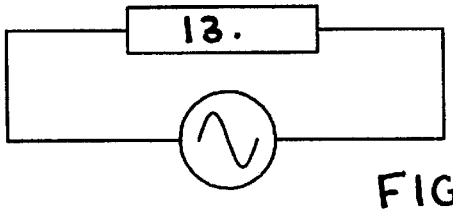
FIGS. 5A and 5B are circuit diagrams showing the electrical connections of the heater of FIG. 4.

In FIG. 4, a first heating element 13 is provided which is adapted and arranged to operate in exactly the same way as the first heating element 6 of FIG. 3 and is energised alone as indicated in FIG. 5A to fulfil the same browning or grilling function as the heating element 6 of FIG. 3.

Two further heating elements 14 and 15 are provided. One of the further elements 14 is of substantially complementary form to the first element 13 and of substantially the same electrical resistance. The other of the further elements 15 is provided surrounding the elements 13 and 14.

Figure 5B:
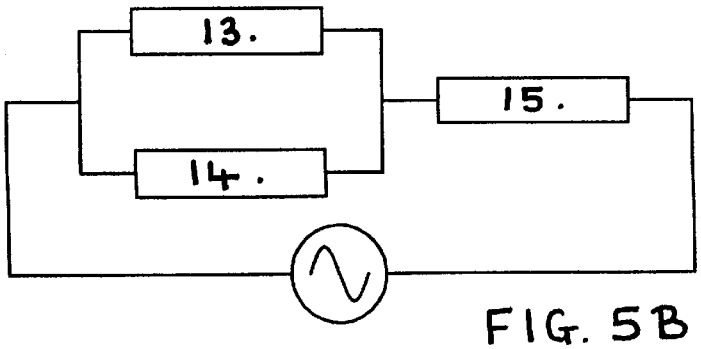

In effect a plurality of second heating elements is provided, connected for operation as shown in FIG. 5B, and comprising the other of the further heating elements 15 connected in series with a parallel combination of the first heating element 13 and the one of the further heating elements 14. This effective plurality of second heating elements is arranged to provide a lower power density (for example of the order of 2 watts per square centimeter) than the first heating element 13 operating alone (for example of the order of 5 watts per square centimeter).

The heater of FIG. 4 achieves effectively similar browning/grilling performance from the first heating element 13 operated alone as is achieved by the heating element 6 of FIG. 3, and very uniform baking performance from the operating combination of the heating elements 13, 14 and 15.

Figure 6:
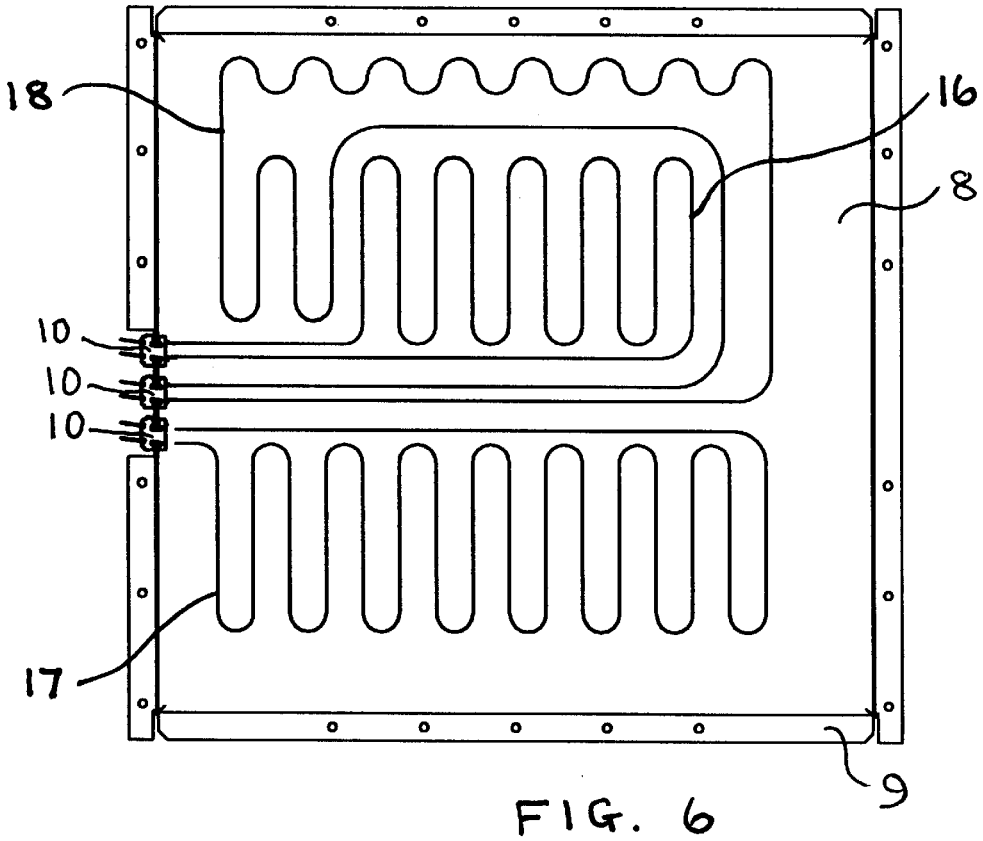
FIG. 6 is a plan view of a further arrangement of radiant electric heater according to the present invention.

A further form of heater may be provided as shown in FIG. 6.

Figure 7A:
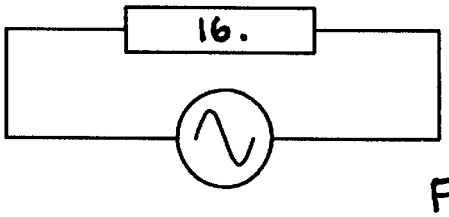
FIGS. 7A and 7B are circuit diagrams showing the electrical connections of the heater of FIG. 6.

In FIG. 6 a first heating element 16 is provided of substantially rectangular shape and which is adapted and arranged to operate in the same way as the part-annular or arcuate first heating element 6 of FIG. 3 and is energised alone as indicated in FIG. 7A to fulfil the same browning or grilling function as the heating element 6 of FIG. 3.

First and second further heating elements 17 and 18 are provided.

Figure 7B:
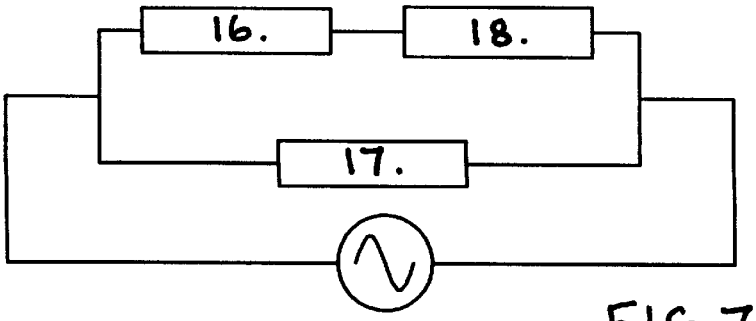

In effect a plurality of second heating elements are provided, connected for operation as shown in FIG. 7B and comprising the first further heating element 17 connected in parallel with a series combination of the first heating element 16 and the second further heating element 18. This effective plurality of second heating elements is arranged to provide a lower power density (for example of the order of 2 watts per square centimetre) than the first heating element 16 operating alone (for example of the order of 5 watts per square centimetre) and provides good baking performance.

What is claimed is:

1. A microwave oven comprising an oven cavity having therein a rotatable turntable, for supporting one or more items to be heated, and a radiant electric heater located above the turntable and comprising at least one first heating element and at least one second heating element, the at least one first heating element being adapted and arranged to overlie only a portion of the total upper surface area of the turntable to the extent that in operation alone, for each complete rotation of the turntable substantially all parts of the upper surface of the turntable are heated for substantially the same duration of time, the at least one first heating element providing a first power density, and the at least one second heating element being adapted and arranged such that it, or a combination thereof with the at least one first heating element, overlies substantially the total upper surface area of the turntable, and such that the at least one second heating element operated alone, or an operating combination of the at least one second heating element with the at least one first heating element, provides a second power density lower than the first power density.

2. A microwave oven according to claim 1, wherein the at least one first heating element is located within the confines of the at least one second heating element.

3. A microwave oven according to claim 1, wherein the at least one first heating element is provided to occupy a region selected from a substantially rectangular, a part-annular, and an arcuate, region of the heater.

4. A microwave oven according to claim 3, wherein the region of the heater subtends an angle of about 180 degrees.

5. A microwave oven according to claim 1, wherein a single first heating element and a single second heating element are provided.

6. A microwave oven according to claim 1, wherein a single first heating element and two further heating elements are provided, one of the further heating elements being arranged substantially complementary to the first heating element, a plurality of second heating elements being provided in operation comprising the other of the further heating elements connected in series with a parallel combination of the first heating element and the one of the further heating elements.

7. A microwave oven according to claim 1, wherein at least one first heating element and first and second further heating elements are provided, a plurality of second heating elements being provided in operation comprising the first of the further heating elements connected in parallel with a series combination of the at least one first heating element and the second of the further heating elements.

8. A microwave oven according to claim 1, wherein the at least one first heating element is located in the heater such as to be as remote as possible from a door of the microwave oven.

9. A microwave oven according to claim 1, wherein the first power density is such as to provide at least one of griling and browning of at least one food item located in the oven cavity.

10. A microwave oven according to claim 1, wherein the second power density is such as to provide baking of at least one food item located in the oven cavity.

11. A microwave oven according to claim 1, wherein the at least one first heating element and the at least one second heating element are selected from coiled wire, metal ribbon, metal foil, and lamp, forms, and combinations thereof.

12. A microwave oven according to claim 1, wherein the at least one first heating element and the at least one second heating element are supported relative to a base of thermal insulation material.

13. A microwave oven according to claim 12, wherein the thermal insulation material comprises microporous thermal insulation material.

14. A microwave oven according to claim 1, wherein a dish-like supporting means is provided for the heater.

* * * * *